US010500476B2

(12) United States Patent
Farr

(10) Patent No.: US 10,500,476 B2
(45) Date of Patent: Dec. 10, 2019

(54) MOVING WEIGHT SYSTEM FOR A CUE STICK

(71) Applicant: Glen Farr, Buford, GA (US)

(72) Inventor: Glen Farr, Buford, GA (US)

( * ) Notice: Subject to any disclaimer, the term of this patent is extended or adjusted under 35 U.S.C. 154(b) by 0 days.

(21) Appl. No.: 16/121,255

(22) Filed: Sep. 4, 2018

(65) Prior Publication Data

US 2019/0070487 A1 Mar. 7, 2019

Related U.S. Application Data

(60) Provisional application No. 62/553,808, filed on Sep. 2, 2017.

(51) Int. Cl.
*A63D 15/08* (2006.01)
*A63B 60/04* (2015.01)

(52) U.S. Cl.
CPC ..... *A63D 15/083* (2013.01); *A63D 15/08* (2013.01); *A63B 60/04* (2015.10)

(58) Field of Classification Search
CPC ..... A63D 15/08; A63B 60/04
USPC ..... 473/44–49, 519, 520
See application file for complete search history.

(56) References Cited

U.S. PATENT DOCUMENTS 507,471 A * 10/1893 Barger ..... A63D 15/16 473/36
935,218 A * 9/1909 Moore ..... A63D 15/08 473/47
1,705,353 A * 3/1929 Barrett ..... A63D 15/08 473/47
3,232,613 A * 2/1966 Laube, Jr. ..... A63D 15/08 403/296
3,342,489 A * 9/1967 Waldo ..... A63D 15/08 273/129 R
3,372,932 A * 3/1968 Molis ..... A63D 15/08 473/2
4,182,512 A * 1/1980 Kuebler ..... A63B 49/00 473/521
5,180,163 A * 1/1993 Lanctot ..... A63B 60/10 473/520
5,197,732 A * 3/1993 Lanctot ..... A63B 60/54 473/523
5,326,329 A * 7/1994 Doss ..... A63D 15/08 473/44
5,454,562 A * 10/1995 Sommer ..... A63B 60/00 473/523
6,881,153 B2 * 4/2005 Andrews ..... A63D 15/083 473/47
7,749,091 B2 * 7/2010 Shields ..... G01M 1/365 473/44
2004/0142754 A1 7/2004 McKevitt et al.

* cited by examiner

*Primary Examiner* — Mark S Graham
(74) *Attorney, Agent, or Firm* — Incorporating Innovation LLC; Charlena Thorpe, Esq.

(57) ABSTRACT

A weight system for a cue stick includes a housing and a set of weighted elements enclosed within the housing. The housing is enclosed within a cavity of the cue stick, the housing having a first end and a second end. The weighted elements are sized to enable the set of weighted elements to move between the first and second ends of the housing during movement of the cue stick.

17 Claims, 7 Drawing Sheets

MOVING WEIGHT SYSTEM FOR A CUE STICK

RELATED APPLICATIONS

The present application is related to and claims benefit under 35 U.S.C. § 119(e) from U.S. Provisional Patent Application Ser. No. 62/553,808 filed Sep. 2, 2017, titled "Moving Weight for Billiard Cues or Snooker Cues" the entire contents of which is incorporated herein by reference.

FIELD

The present disclosure relates generally to cue sticks and more particularly to a moving weight system for a cue stick.

BACKGROUND

Cue sports, also known as billiard sports, are a wide variety of games of skill generally played with a cue stick, which is used to strike a cue ball and thereby cause the cue ball and object balls hit by the cue ball to move around a cloth-covered table bounded by elastic bumpers known as cushions. The design of the cue stick directly impacts how effectively a player can both strike the cue balls and cause dispersion of object balls to desired locations on the table. For example, cue sticks are typically designed with fixed or adjustable weight, in the form of one or more weighted metal bolts, added within the handle of the cue stick. The added weight not only impacts how the cue stick strikes a cue ball but also affects the "feel" of the cue stick to a user, which can add to or detract from the user's effectiveness at the game. However, current weight systems added to the cue stick are still limited in other aspects, for instance in: creating sufficient force during an initial break of the object balls for optimum dispersion; assisting the user's stroke to stay online; and imparting a spin to the cue ball. Thus, a need exists for a weight system for a cue stick that can address at least some of the above-referenced shortcomings.

BRIEF SUMMARY

The teachings herein include embodiments of a moving weight system for a cue stick and a cue stick that includes the moving weight system, wherein the cue stick has a handle portion coupled to a narrower shaft portion. The weight system includes a housing enclosed within a cavity of the cue stick, the housing having a first end and a second end. The weight system further includes a set of weighted elements, such as weighted balls, enclosed within the housing. The weighted elements are sized to enable the set of weighted elements to move between the first and second ends of the housing when the cue stick is moved. For another embodiment, the weight system further includes a liquid, such as a weighted oil, enclosed within the housing with the set of weighted elements.

For a further embodiment, the weight system includes: a second housing enclosed within a second cavity of the cue stick, the second housing having a first end and a second end; and a second set of weighted elements enclosed within the second housing, wherein the weighted elements in the second set are sized to enable the second set of weighted elements to move between the first and second ends of the second housing. As an example, one housing is enclosed within a cavity in the handle portion of the cue stick, and the second housing is enclosed within a second cavity in the shaft portion of the cue stick.

Another described embodiment is a method for making a weighted cue stick. The method includes creating a cavity in the cue stick and inserting a weight system within the cavity, the weight system including a housing having first and second ends and a set of weighted elements enclosed within the housing, wherein the weighted elements are sized to enable the set of weighted elements to move between the first and second ends of the housing. The method further includes securing the housing within the cavity of the cue stick. For another embodiment, the method further includes creating a second cavity in the cue stick, inserting a second weight system (or a second portion of a weight system) within the second cavity; and securing the second weight system (or portion of the weight system) within the second cavity of the cue stick. The second weight system (or second portion of a weight system) includes a second housing having first and second ends and a second set of weighted elements enclosed within the second housing, wherein the weighted elements in the second set are sized to enable the second set of weighted elements to move between the first and second ends of the second housing.

BRIEF DESCRIPTION OF THE DRAWINGS

The accompanying figures, for which like reference numerals refer to identical or functionally similar elements throughout the separate views, together with the detailed description below, are incorporated in and form part of the specification. The figures serve to illustrate embodiments of concepts included in the claims and to show various features and advantages of those embodiments.

Figure 1:
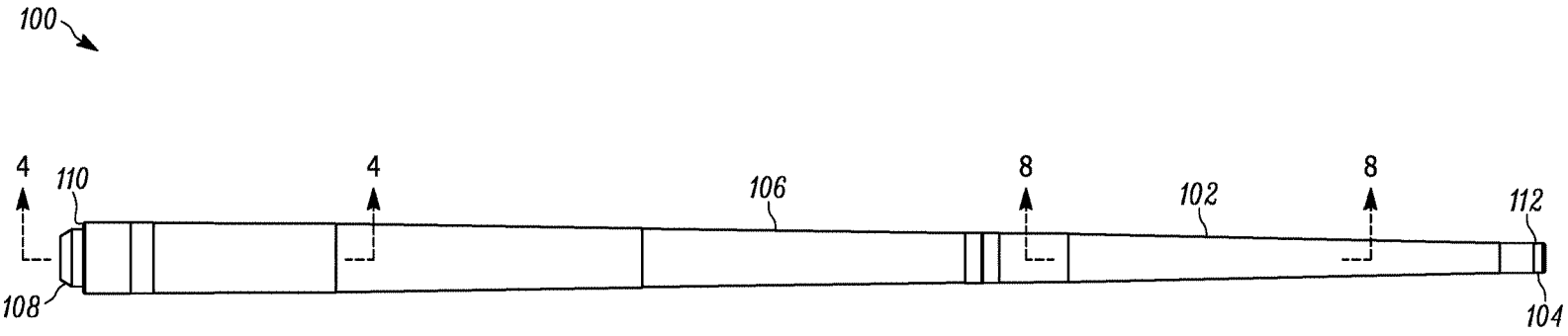
FIG. 1 illustrates a side elevational view of a cue stick that has installed therein a weight system in accordance with an embodiment.

The present disclosure is illustrated in part with examples, as reflected by disclosed embodiments, and is not limited by the accompanying figures, in which like reference numbers indicate similar elements. Skilled artisans will appreciate that elements in the figures are illustrated for simplicity and clarity and have not necessarily been drawn to scale. For example, the dimensions of some of the elements in the figures may be exaggerated relative to the dimensions of other elements to help to improve understanding of embodiments implicitly or explicitly disclosed herein.

The apparatus and method components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Also, the operations included in the flow diagrams do not imply a required order in performing the functionality and/or steps contained therein.

DETAILED DESCRIPTION

The disclosure describes embodiments of a moving weight system for a cue stick. FIG. 1 illustrates a side elevational view of a cue stick 100 that has installed therein a weight system (e.g., weight system 200 of FIG. 2) in accordance with an embodiment. The cue stick 100 includes a shaft portion 102 (also referred to herein simply as a shaft) terminating in a ferrule end 112 coupled to a handle or butt portion 106 (also referred to herein simply as a handle) terminating in a terminal end 110. As can be seen, the cue stick 100 tapers from the terminal end 110 of the handle 106 to the ferrule end 112 of the shaft 102. Thus, the shaft 102 is narrower than the handle 106. A bumper or end cap 108 is mounted to the terminal end 110 of the handle 106, and a tip 104 is mounted to the ferrule end 112 of the shaft 102.

The weight system 200 can be installed within any suitable cue stick 100, including those well known in the art. For example, the cue stick 100 can be constructed from any suitable material or combination of materials including, but not limited to, wood, fiberglass, carbon fiber, aluminum, etc., for the shafts and handles. Moreover, the cue stick 100 can be of any suitable type including, but not limited to, a pool cue, a billiard cue, a carom cue, a snooker cue, a break cue, a shooter cue, etc. Additionally, the cue stick 100 can be a one-piece cue stick or a multi-piece cue stick, for instance a two-piece cue stick attached at a joint.

Figure 2:
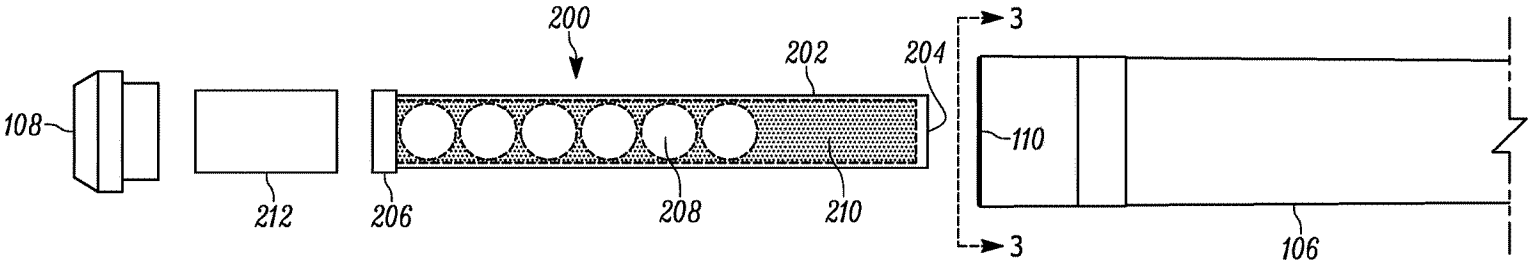
FIG. 2 illustrates an exploded elevational view of the weight system in accordance with an embodiment installable within a handle portion of the cue stick of FIG. 1.

FIG. 2 illustrates an exploded elevational view of the weight system 200 installable through the terminal end 110 of the handle portion 106 of the cue stick 100 of FIG. 1. The weight system 200 includes: a housing 202 having ends 204 and 206, which can be enclosed within a cavity of the cue stick 100, in this case a cavity of the handle 106; and a set of weighted elements 208 enclosed within the housing 202. As used in this disclosure, a "set" of weighted elements includes one or more weighted elements, with six weighted elements 208 illustrated in FIG. 2. For an embodiment, the weight system 200 also includes a liquid 210 enclosed within the housing 202 with and surrounding the set of weighted elements 208. For a further embodiment, a closure 212 is inserted between the end 206 of the housing 202 and the end cap 108 to hold the weight system 200 in place when installed.

Figure 3:
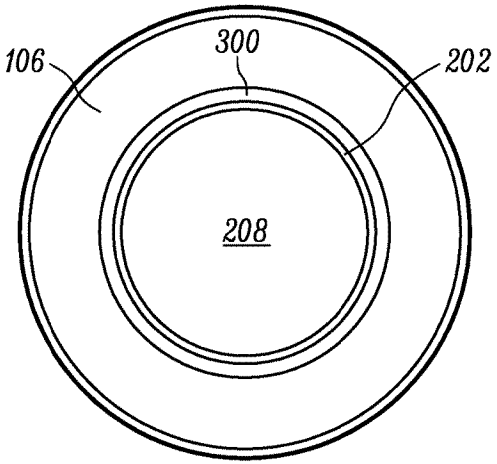
FIG. 3 illustrates an end view taken along line 3-3 of the terminal end of the handle portion of the cue stick of FIGS. 1 and 2 showing the weight system installed within a cavity of the handle portion of the cue stick.

FIG. 3 illustrates an end view taken along line 3-3 of the terminal end 110 of the handle portion 106 of the cue stick 100 of FIGS. 1 and 2 and shows the weight system 200 installed within a cavity 300 of the handle portion 106 of the cue stick 100. To facilitate ease of installation of the weight system 200 into the cue stick 100 and further facilitate holding the weight system 200 in place once installed, cross-sections of the cavity 300 and the housing 202 are similarly shaped. For the embodiment shown, the cross-sections of the cavity 300 and the housing 202 are circular. Correspondingly, the cavity 300 and the housing 202 are tubular or cylindrically shaped. As an example, the diameter of the cavity 300 is $11/16^{th}$ of an inch, and the diameter of the housing 202 is between $5/8^{th}$ and substantially $11/16^{th}$ of an inch. Other, e.g., smaller, diameters may be utilized, for instance where a weight system in accordance with the present teachings is installed in other areas of the cue stick 100 such as the narrower shaft 102.

Other shapes of the housing 202 and the cavity 300 within which it lies can be envisioned, for instance for specialty cue sticks. However, utilizing cylindrical shapes lend to ease of fabricating the housing 202 and of creating the cavity 300.

Furthermore, the weighted elements 208 are sized to enable the set of weighted elements to move between the ends 204 and 206 of the housing 202 when the cue stick 100 is moved. Accordingly, in the illustrated embodiment, the weighted elements 208 are spherically shaped with a circular cross-section as shown in FIG. 3 and are also referred to herein as weighted balls. For an alternative embodiment, the weighted elements 208 can have a different shape that still enables them to roll (such as a disk shape) or slide (such as an egg or cylinder shape) within the housing 202. Springs or magnets could be attached at or proximate the ends 204, 206 of the housing 202 to facilitate movement of the weighted elements 208 from one end 204 to the other end 206, for example as described below by reference to FIGS. 10 and 11.

Figure 4:
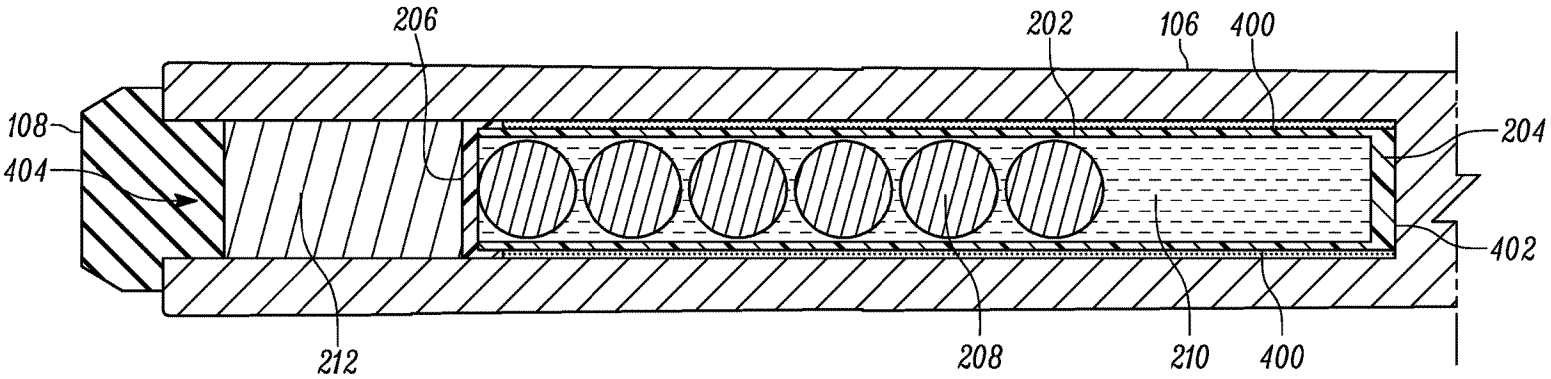
FIG. 4 illustrates a cross-sectional view along a line 4-4 of the cue stick of FIGS. 1 and 2, showing the weight system installed within the cavity of the handle portion of the cue stick.

FIG. 4 illustrates a cross-sectional view along a line 4-4 of the cue stick 100 of FIGS. 1 and 2, showing the weight system 200 installed within the cavity 300 of the handle portion 106 of the cue stick 100. Lengths of the cavity 300 and the housing 202 axially extend along a length of the handle 106. When installed, the end 204 of the housing 202 is closest to a closed end 402 of the cavity 300, and the end 206 of the housing 202 is closest to an open end 404 of the cavity 300. For a particular example, the cavity 300 is 15 inches in length, and the housing 202 is between 4 to 12 inches long depending at least in part on one or more of where the weight system 200 is installed within the cue stick 100, the desired amount of weight added to the cue stick 100, and a desired balance point of the cue stick 100.

As can be seen, the housing 202 is inserted into the cavity 300 such that the end 204 is proximate the closed end 402 of the cavity 300. Similarly, sides of the housing 202 are proximate to sides of the cavity 300. For an embodiment, material 400 is inserted between the sides and/or end 204 of the housing 202 and the sides and/or closed end 402 of the cavity 300. The material 400 can be any suitable material that prevents friction with the material of the housing 202 and that stabilizes the housing 202 within the cavity 300. For another embodiment, the material has adhesive qualities where the housing 202 is not intended to be removable from the cavity 300. An example material is silicon, for instance a silicon adhesive or caulk.

The closure 212 is inserted into the cavity 300 to fill or substantially fill any gap within the cavity 300 between the end 206 of the housing 202 and the end cap 108, which is inserted or mounted into the open end 404 of the cavity. For the embodiment shown, the closure 212 is cylindrically shaped such that it has a cross-section that is circular, similarly to the cross-sections of the cavity 300, the housing 202, and the weighted balls 208. For one example, the weighted balls 208 have a diameter between ½ and ⅝$^{th}$ inch depending at least in part on the diameter of the housing 202 and the desired weight to be added to the cue stick 100. The closure 212 can be made of any suitable material, such as wood, metal, plastic, rubber, etc.

The elements 208 are weighted with predetermined weights to give the user a desired feel when handling the cue stick 100 and to create a desired balance point in the cue stick 100. For instance, the elements 208 weigh between 1/15$^{th}$ and 2/5$^{th}$ of an ounce and can be constructed using any suitable material such as stainless steel, lead, or other metals that minimize corrosion and/or are relatively inexpensive. Moreover, the weight and number of the elements 208 can also depend at least in part on one or a combination of: user preference for weighting the cue stick 100 based on feel; the weight of the cue stick 100, for example, lighter and fewer weighted elements 208 might be used within a weight system 200 installed in a lighter cue stick 100; and a desired balance point for the cue stick 100.

For a further embodiment, the weight system 200 includes the liquid 210 having a predetermined weight to fine-tune the overall weight of the weight system 200. For a particular embodiment, the liquid 210 is an oil, and the oil is a weighted oil. As a non-limiting example, the oil is motor oil having a viscosity between 5 and 50.

Figure 5:
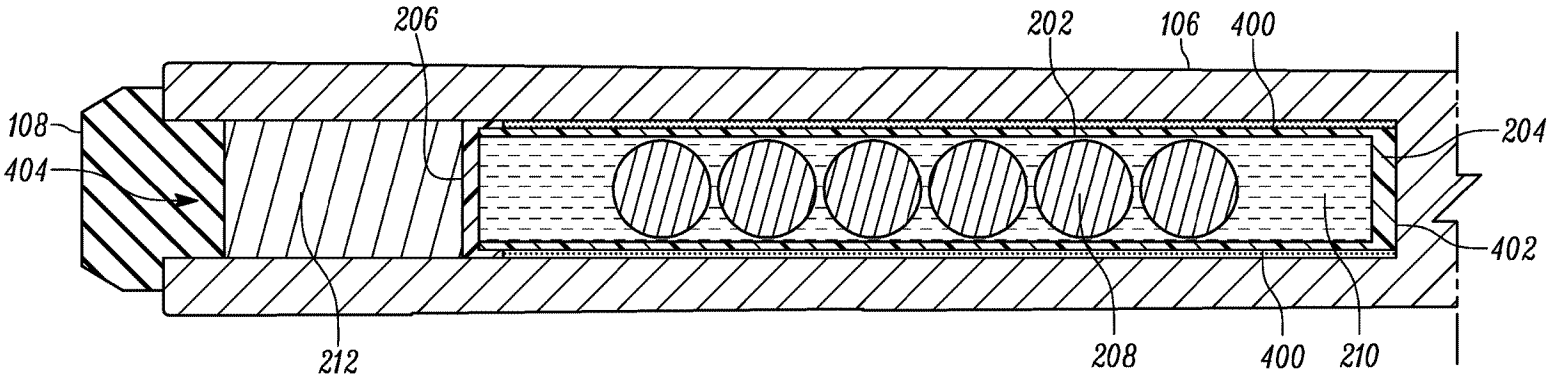
FIG. 5 illustrates weighted balls of the weight system shown in FIG. 4 having moved to a second location near the center of a housing of the weight system shown in FIG. 4.
Figure 6:
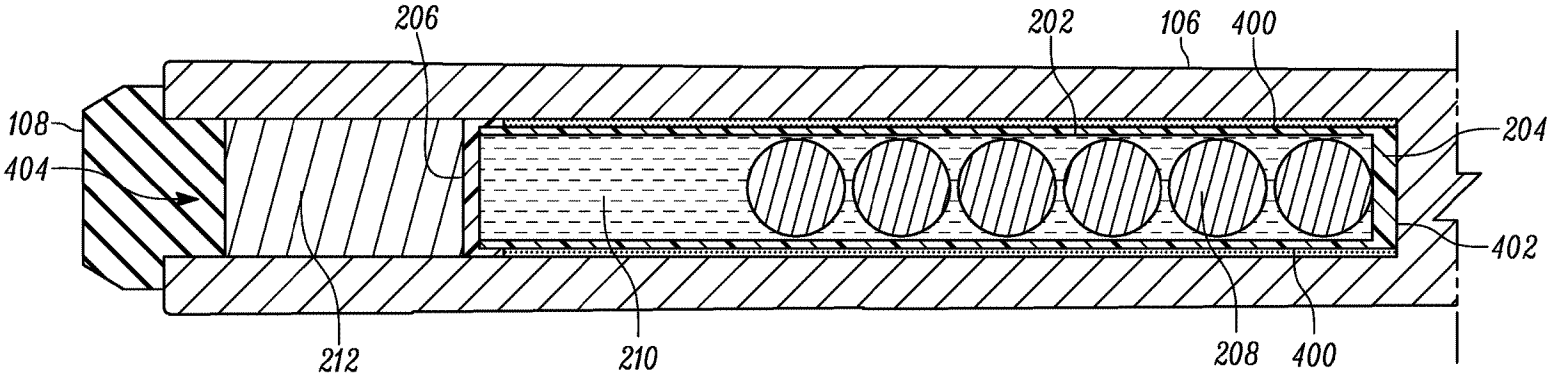
FIG. 6 illustrates the weighted balls in the weight system shown in FIG. 4 having moved to a third location near an end of the housing farthest from the terminal end of the handle portion of the cue stick.

Additionally, for each embodiment of the disclosure, the weight system 200 is a "moving" weight system, meaning that the housing 202, weighted elements 208, and (if included) liquid 210 are designed and, for a particular embodiment, optimized to facilitate the movement of the weighted elements 208 from one end 206 to the other end 204 of the housing 202, as illustrated for instance by reference to FIGS. 5 and 6. Specifically, FIG. 5 illustrates the weighted balls 208 of the weight system 200 having moved to a second location near the center of the housing 202 of the weight system 200, and FIG. 6 illustrates the weighted balls 208 having moved to a third location near the end 204 of the housing 202 farthest from the terminal end 110 of the handle portion 106 of the cue stick 100. Additionally, for the embodiment where the liquid 210 is used, the type of liquid 210 can be optimized to dampen the roll and, thereby, enable smoother movement of the weighted elements 208 within the moving weight system 200 during strokes as a user handles the cue stick 100 while minimizing sound and feel of the weighted elements 208 contacting the sides and ends 204, 206 of the housing 202.

Movement of the weighted elements 208 is beneficial during strokes for multiple reasons. In general, when a user strokes back, the weighted elements 208 move forward, and when the user strokes forward, the weighted elements 208 move back. Then when the cue stick 100 hits a cue ball, the weighted elements 208 move forward enhancing the hit. More particularly, because the weighted elements 208 move in a straight line during the stroke, the cue stick 100 tends to stay online longer and any offline movement by the arm of the user will have less effect. This is due to Newton's first law of motion, which says that an object in motion tends to stay in motion and in the same direction.

Moreover, billiards players tend to hold the cue stick 100 lightly and therefore the movement of the weighted elements 208 tends to increase the foot pounds of energy imparted by the cue tip 104 to the cue ball at impact by 1.8 to 3.7 percent at the same stroke speeds. This means that the cue ball will leave the cue stick 100 at a higher rate of speed and with a more solid hit due to the moving weighted system 200. This creates a better dispersion of the object balls on a break and makes it easier to impart spin (English) to the cue ball without having to move the cue tip 104 as far from the center of the cue, thus creating more spin with a more solid hit to the cue ball. Additionally, the increased energy enables a user to make a more confident slower stroke and achieve the same solid hit with the same foot-pounds of energy as a faster less controlled stroke.

Figure 7:
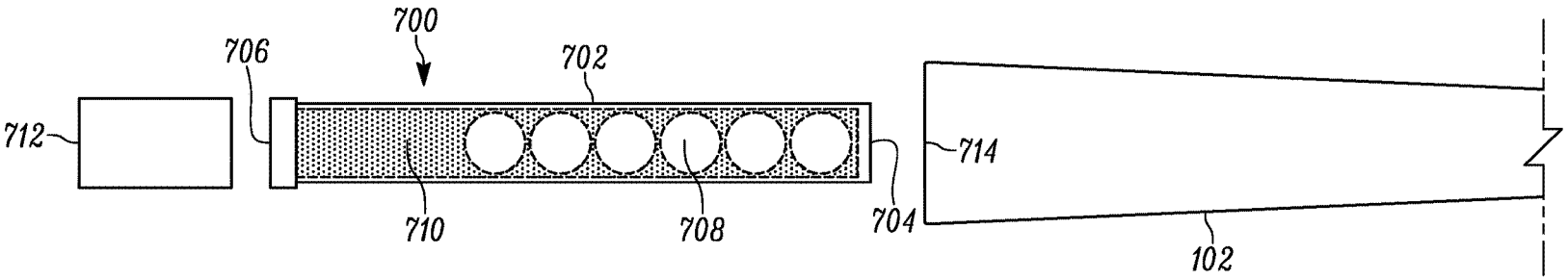
FIG. 7 illustrates an exploded elevational view of a weight system in accordance with an embodiment and installed within a shaft portion of the cue stick of FIG. 1.

FIG. 7 illustrates an exploded elevational view of a weight system 700 installable through an end 714 of the shaft portion 102 of the cue stick 100 of FIG. 1. As an example, the end 714 is at a joint between the shaft 102 and the handle 106, such as in a two-piece cue stick. The weight system 700 includes: a housing 702 having ends 704 and 706, which can be enclosed within a cavity of the cue stick 100, in this case a cavity (not shown) of the shaft 102; and a set of weighted elements 708 enclosed within the housing 702. For an embodiment, the weight system 700 also includes a liquid 710, such as a weighted oil, enclosed within the housing 702 with the set of weighted elements 708. For a further embodiment, a closure 712 is inserted proximate the end 706 of the housing 702 to hold the weight system 700 in place when installed.

Current mechanisms for weighting a cue stick do not add weight to the shaft of the cue stick because it could negatively impact a user's stroke since it would tend to decrease the amount of control the user has during the stroke. Namely, where a user's stroke is offline, this error would tend to be increased if the shaft were weighted. However, this is not the case with the moving weight system of the present disclosure. By contrast, since the moving weight system has the effect of improving an online stroke, adding weight closer to the tip of the cue stick tends to improve dispersion of the object balls due to the increased energy and force imparted to the cue ball, especially at initial breaking.

For one embodiment, a single moving weight system in accordance with the present teachings (i.e., having a single housing enclosing a single set of weighted elements) in installed in a cue stick. For another embodiment multiple moving weight systems each having a housing enclosing a set of weighted elements (or stated a different way a moving weight system with multiple housings each having a set of weighted elements) is installed in a cue stick. For a particular embodiment, both the weight system 200 and the weight system 700 are installed in the cue stick 100. For yet another embodiment, the cue stick 100 is configured at a joint between the handle 106 and the shaft 102 to enable an extension to be mounted, using any suitable types of fasteners, between the handle 106 and the shaft 102 to extend the length of cue stick 100. In this embodiment, a weight system in accordance with the teachings herein is installed within the extension in addition to or instead of in the handle 106 and/or shaft 102.

Figure 8:
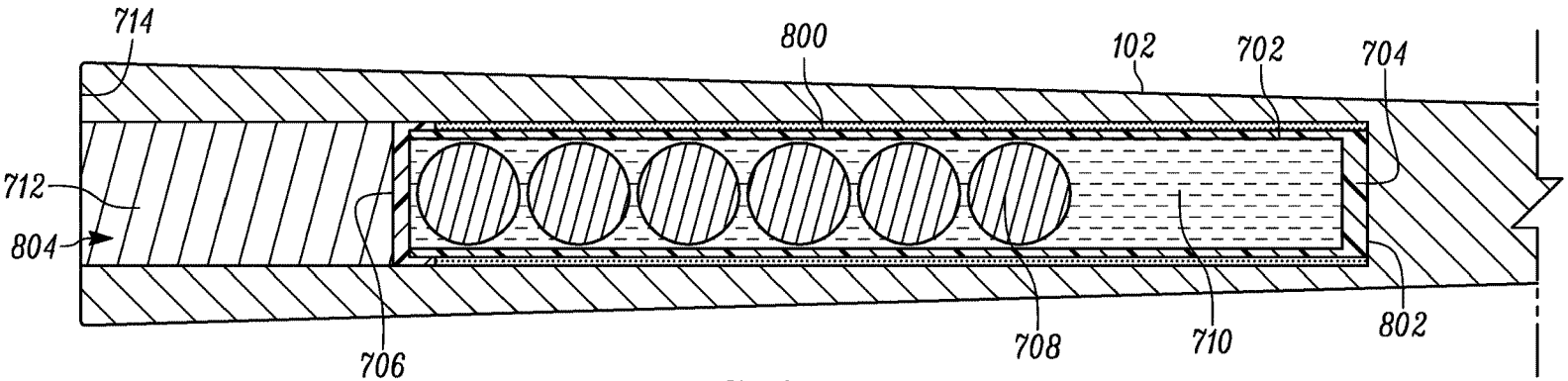
FIG. 8 illustrates a cross-sectional view along a line 8-8 of the cue stick of FIGS. 1 and 7, showing the weight system installed within a cavity of the shaft portion of the cue stick.

FIG. 8 illustrates a cross-sectional view along a line 8-8 of the cue stick 100 of FIGS. 1 and 7, showing the weight system 700 installed within the cavity of the shaft portion 102 of the cue stick 100. Lengths of the cavity and the housing 702 axially extend along a length of the shaft 102. When installed, the end 704 of the housing 702 is closest to a closed end 802 of the cavity and the end 706 of the housing 702 is closest to an open end 804 of the cavity, for instance at the joint 714.

As can be seen, the housing 702 is inserted into the cavity such that the end 704 is proximate the closed end 802 of the cavity. Similarly, sides of the housing 702 are proximate to sides of the cavity. For an embodiment, material 800, such as silicon, is inserted between the sides and/or end 704 of the housing 702 and the sides and/or closed end 802 of the cavity. The closure 712 is inserted into the open end 804 of the cavity to fill or substantially fill any gap within the cavity between the end 706 of the housing 702 and the joint 714. Length of the housing 802, the number of weighted elements 708, the type and weight of the liquid 710, and the placement of the weight system 700 within the shaft 102 can be optimized based on, for example, a desired feel for the user, a desired balance point, smoothness of movement of the weighted elements 708 within the housing 702, and/or maximum increased energy imparted to the tip 104 of the cue stick 100.

Figure 9:
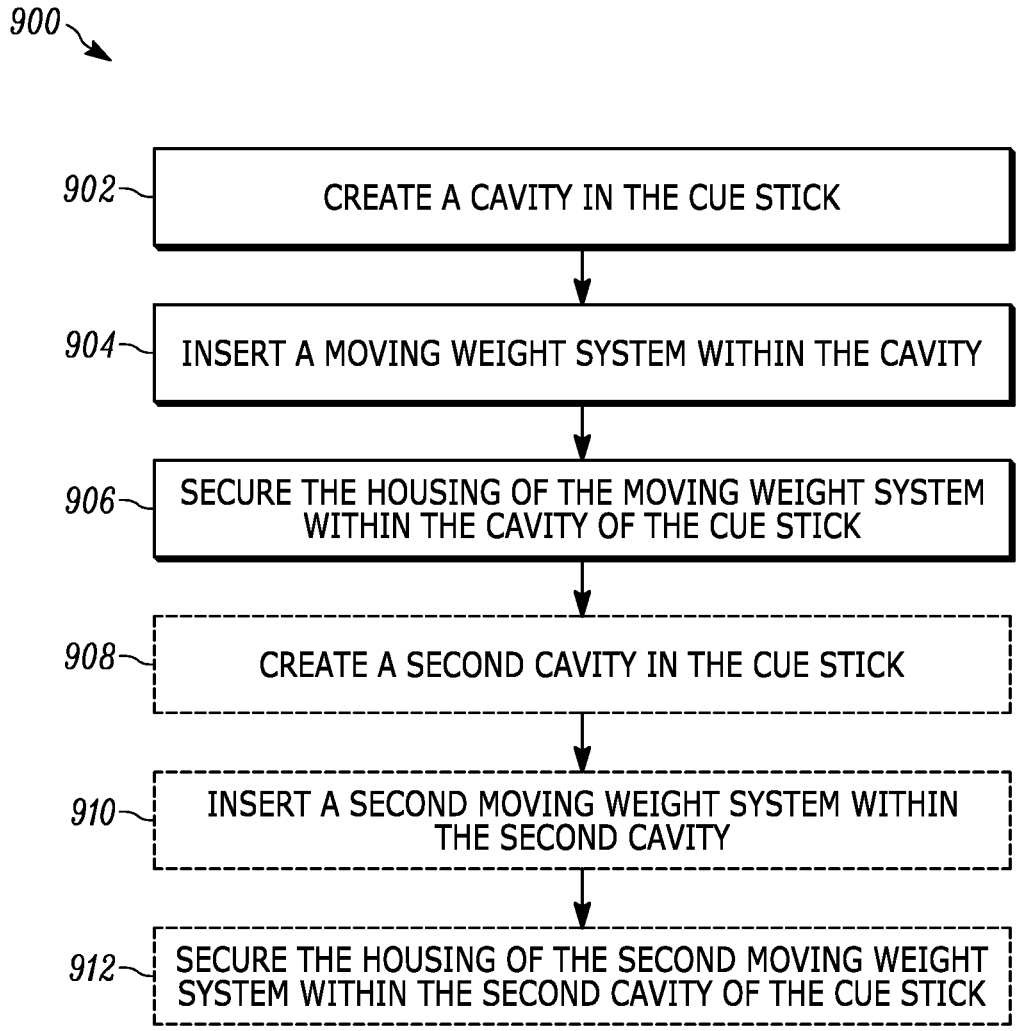
FIG. 9 illustrates a flow diagram depicting a method for assembling a cue stick having a weight system in accordance with an embodiment.

FIG. 9 illustrates a flow diagram 900 depicting a method for assembling a cue stick having a weight system in accordance with an embodiment, for example the cue stick 100 of FIG. 1. For one embodiment, a single moving weight system according to the present teachings is installed within the cue stick 100, for instance in the handle 106, the shaft 102, or an extension therebetween, by implementing blocks 902, 904, and 906 of the flow diagram 900. The blocks of the flow diagram 900 can be implemented using a process that includes one or both of a person or persons hand-crafting the cue stick 100 and/or manufacturing machinery.

Particularly, a cavity is created 902 in the cue stick 100, such as by drilling a hole having the desired with and depth. The moving weight system is inserted 904 in the cavity. The moving weight system can likely be fashioned using one or a combination of hand-crafting or machinery to include the elements as described above to have the desired weight. The housing of the moving weight system is then secured 906 within the cavity of the cue stick 100. For the embodiments described above, the housing is permanently secured within the cavity using adhesives to bind one end and/or the sides of the housing to the closed end and/or sides of the cavity within the cue stick 100, as well as insertion of a closure at the other end of the housing. For additional embodiments described by reference to FIGS. 12 and 13, the moving weight system is removably inserted into the cavity of the cue stick 100.

For another embodiment of the flow diagram 900, multiple moving weight systems are inserted within the cue stick 100, for example in any combination of the handle 106, the shaft 102, and an extension therebetween. For this embodiment, blocks 908, 910, and 912 are implemented. Particularly, a second cavity is created 908 in the cue stick 100. A second moving weight system is inserted 910 into the cavity, and the housing of the second moving weight system is secured 912 within the cavity of the cue stick 100. Moreover, although the flow diagram 900 depicts only up to two moving weight systems installed in the cue stick 100, additional weight systems might be installed to optimize one or more of the benefits.

Figure 10:
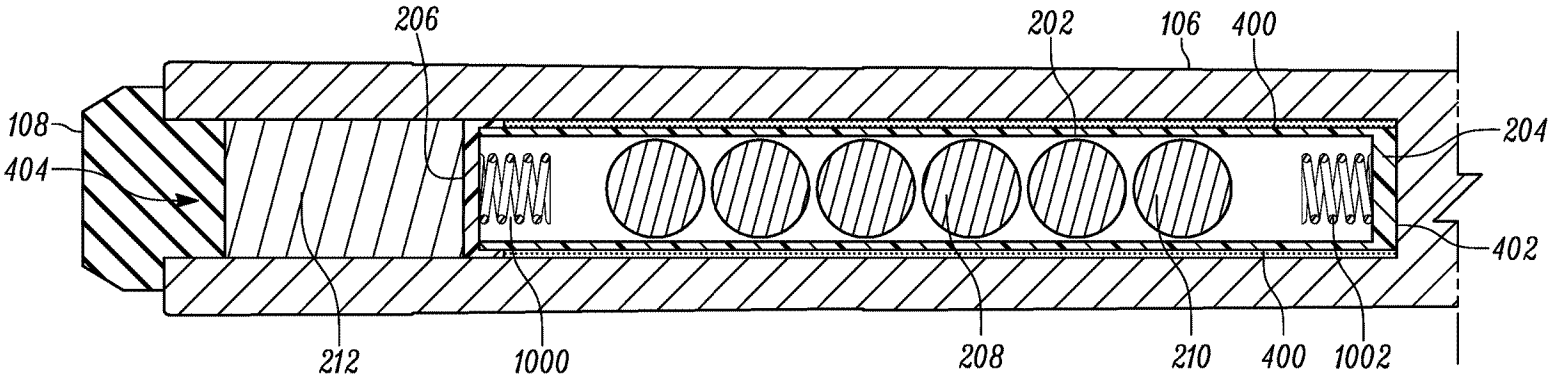
FIG. 10 illustrates a cross-sectional view along the line 4-4 of the cue stick of FIGS. 1 and 2, showing a weight system in accordance with another embodiment installed within the cavity of the handle portion of the cue stick.
Figure 11:
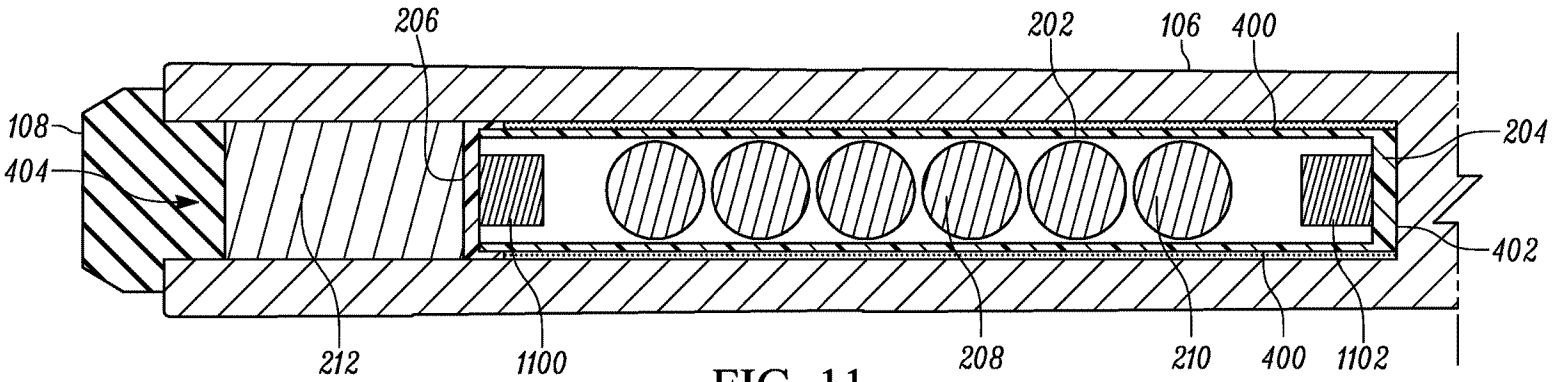
FIG. 11 illustrates a cross-sectional view along the line 4-4 of the cue stick of FIGS. 1 and 2, showing a weight system in accordance with a further embodiment installed within the cavity of the handle portion of the cue stick.

Additional embodiments of a moving weight system according to the present teachings can be implemented to facilitate movement of the weighted elements within the housing. FIGS. 10 and 11 illustrates such additional embodiments. These embodiments illustrate the moving weight system being installed in the handle 106 of the cue stick but can be installed in the shaft 102, an extension therebetween, or a combination thereof. FIG. 10 illustrates a cross-sectional view along the line 4-4 of the cue stick of FIGS. 1 and 2, showing the weight system 200 in accordance with another embodiment installed within the cavity of the handle 106 portion of the cue stick 100. This embodiment is similar to the embodiment illustrated by reference to FIG. 4 except that a spring 1002 is mounted to the end 204 of the housing 202, and a spring 1000 is mounted to the end 206 of the housing 202. The springs facilitate a smooth but faster movement of the weighted elements 208 back and forth, which can impart additional energy at impact as the cue stick 100 is stroked.

FIG. 11 illustrates a cross-sectional view along the line 4-4 of the cue stick of FIGS. 1 and 2, showing the weight system 200 in accordance with yet another embodiment installed within the cavity of the handle 106 portion of the cue stick 100. This embodiment is also similar to the embodiment illustrated by reference to FIG. 4 except that a magnet 1102 is mounted to the end 204 of the housing 202, and a magnet 1100 is mounted to the end 206 of the housing 202. The magnets would operate to repel metal weighted elements 208 yet still allow the weighted elements 208 to mover back and forth as the cue stick 100 is stroked.

The above-described embodiments of the moving weight system are directed to moving weight systems that are fixably (or permanently) secured within the cue stick 100, meaning that it is not intended that the moving weight systems be removed once installed. However, in additional embodiments, for instance as illustrated by reference to FIGS. 12 and 13, the moving weight systems are removably installed within the cue stick 100, meaning the it is intended that the moving weight systems be removed and, for an example, replaced by another moving weight system having a different weight. These embodiments illustrate the moving weight system being installed in the handle 106 of the cue stick but can be installed in the shaft 102, an extension therebetween, or a combination thereof.

Figure 12:
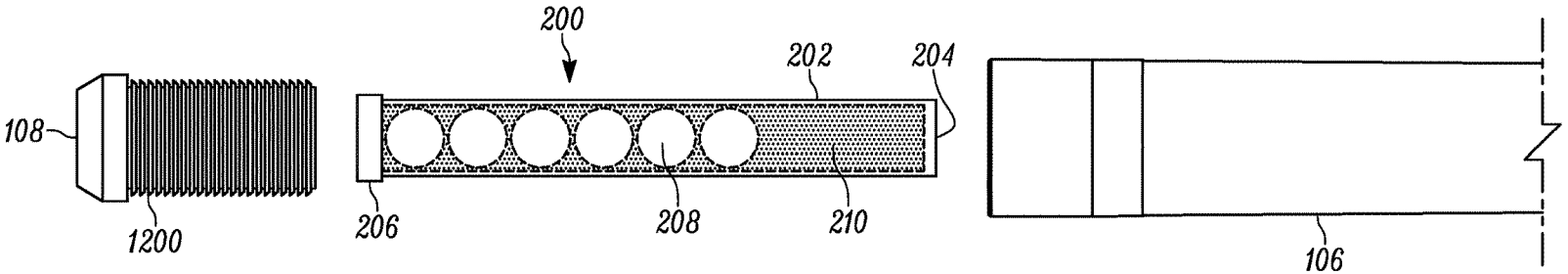
FIG. 12 illustrates an exploded elevational view of a weight system in accordance with another embodiment that is removably installable within the handle portion of the cue stick of FIG. 1.

FIG. 12 illustrates an exploded elevational view of the weight system 200 that is removably installable within the handle portion 106 of the cue stick of FIG. 1. This embodiment is similar to the embodiment illustrated by reference to FIG. 2 except that a closure 1200 is mounted between the end cap 108 and the moving weight system 200. The closure 1200 is threaded to mate with threading inside the cavity (not shown) of the handle 106. The threading allows the end cap 108, closure 1200, and housing 200 to be collectively screwed into and out of the cavity. Moreover, in this embodiment, an adhesive is not use to secure the housing 202 into the cavity for easy removal of the housing 202.

Figure 13:
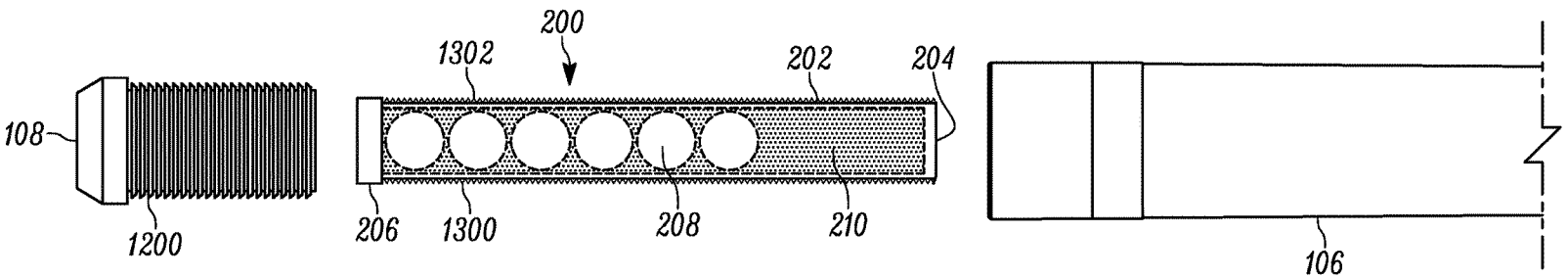
FIG. 13 illustrates an exploded elevational view of a weight system in accordance with a further embodiment that is removably installable within the handle portion of the cue stick of FIG. 1.

Once removed from the cavity, the weight system 200 can be detached from the closure 1200 and replaced with a second housing having a second set of weighted elements enclosed therein. For an embodiment, the second or different weight system has a different weight from the weight system 200. Any suitable means for detachably securing the weight system 200 to the closure 1200 can be used such as any suitable type of plastic or metal fastener, e.g., a clasp or screw. FIG. 13 is similar to the embodiment illustrated in FIG. 12 except sides 1300, 1302 of the housing 202 of the weight system 200 as also threaded to mate with threading inside the cavity.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendment made during the pendency of this application and all equivalents of those claims as issued.

In this document, the terms "comprises," "comprising," "has," "having," "includes," "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. The terms "substantially," "essentially," "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%.

As used herein, the term "configured to," "configured with," "arranged to," "arranged with," "capable of" and any like or similar terms means that referenced elements have a physical arrangement and/or physical coupling and/or connectivity with other elements in an inactive state. This physical arrangement and/or physical coupling and/or connectivity while in the inactive state enables the elements to perform stated functionality while in the active state. Although the various device schematics shown herein depict certain example arrangement of elements, additional intervening elements, devices, features, or components may be present in an actual embodiment, assuming that the functionality of the given device is not adversely affected.

Also, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

I claim:

1. A weight system for a cue stick having a handle portion coupled to a narrower shaft portion, the weight system comprising:

a housing enclosed within a cavity of the cue stick, the housing having a first end and a second end wherein a first magnet is mounted on the first end and a second magnet is mounted on the second end;

a cylinder shape weighted elements enclosed within the housing, wherein the weighted element is sized to enable the weight element to move between the first and second ends of the housing wherein the first magnet and second magnet are configured to repel the weighted element.

2. The weight system of claim 1 further comprising a liquid enclosed within the housing with the weighted element.

3. The weight system of claim 2, wherein the liquid comprises an oil.

4. The weight system of claim 3, wherein the oil comprises a weighted oil.

5. The weight system of claim 1, wherein the housing is enclosed within a cavity in the handle portion of the cue stick.

6. The weight system of claim 5 further comprising:

a second housing enclosed within a second cavity of the cue stick, the second housing having a first end and a second end;

a second cylinder shape weighted element enclosed within the second housing, wherein the weighted element is sized to enable the second weighted element to move between the first and second ends of the second housing.

7. The weight system of claim 6, wherein the second housing is enclosed within a second cavity in the shaft portion of the cue stick.

8. The weight system of claim 1, wherein the housing is tubular-shaped.

9. The weight system of claim 1, wherein the housing is removable from the cue stick for replacing with a second housing having a second set of weighted elements enclosed therein.

10. The weight system of claim 9, wherein sides of the housing are threaded.

11. A cue stick comprising:

a handle portion;

a narrower shaft portion coupled to the handle portion;

a weight system installed within a cavity of the cue stick, the weight system comprising:

a housing enclosed within the cavity of the cue stick, the housing having a first end and a second end wherein a first magnet is mounted on the first end and a second magnet is mounted on the second end;

a cylinder shape weighted elements enclosed within the housing, wherein the weighted element is sized to enable the weighted elements to move between the first and second ends of the housing wherein the first magnet and second magnet are configured to repel the weighted element;

a liquid enclosed within the housing with the weighted element.

12. The cue stick of claim 11, wherein the liquid comprises a weighted oil.

13. The cue stick of claim 11, wherein the housing is tubular-shaped.

14. The cue stick of claim 11, wherein the cavity is within the handle portion of the cue stick.

15. The cue stick of claim 11, wherein the cavity is within the shaft portion of the cue stick.

16. A method for making a weighted cue stick, the method comprising:

creating a cavity in the cue stick;

inserting a weight system within the cavity, the weight system comprising a housing having first and second ends wherein a first magnet is mounted on the first end and a second magnet is mounted on the second end and a cylinder shape weighted element is enclosed within the housing, wherein the weighted element is sized to enable the weighted elements to move between the first and second ends of the housing wherein the first magnet and second magnet are configured to repel the weighted element;

securing the housing within the cavity of the cue stick.

17. The method of claim 16 further comprising:

creating a second cavity in the cue stick;

inserting within the second cavity, a second portion of the weight system comprising a second housing having first and second ends and a second cylinder shape weighted element enclosed within the second housing, wherein the weighted elements in the second set is sized to enable the weighted elements to move between the first and second ends of the second housing;

securing the second housing within the second cavity of the cue stick.

* * * * *